US008412353B2

(12) United States Patent
Kunze

(10) Patent No.: US 8,412,353 B2
(45) Date of Patent: Apr. 2, 2013

(54) METHOD AND DEVICE FOR CONTROLLING A COMPUTER-AIDED ARITHMETIC PROCESS IN A TECHNICAL SYSTEM

(75) Inventor: Ulrich Kunze, Bubenreuth (DE)

(73) Assignee: Siemens Aktiengesellschaft, München (DE)

( * ) Notice: Subject to any disclaimer, the term of this patent is extended or adjusted under 35 U.S.C. 154(b) by 810 days.

(21) Appl. No.: 12/083,425

(22) PCT Filed: Oct. 10, 2006

(86) PCT No.: PCT/EP2006/067226

§ 371 (c)(1),
(2), (4) Date: Apr. 11, 2008

(87) PCT Pub. No.: WO2007/042513

PCT Pub. Date: Apr. 19, 2007

(65) Prior Publication Data

US 2009/0234466 A1 Sep. 17, 2009

(30) Foreign Application Priority Data

Oct. 12, 2005 (EP) ..... 05022275

(51) Int. Cl.

| | |
|---|---|
| ***G05B 11/01*** | (2006.01) |
| ***G05B 15/00*** | (2006.01) |
| ***G05B 23/02*** | (2006.01) |
| ***G06F 15/16*** | (2006.01) |
| ***G06F 17/28*** | (2006.01) |

(52) U.S. Cl. ..... 700/17; 700/26; 700/86; 340/3.1; 709/203; 715/700

(58) Field of Classification Search ..... 700/17, 700/20, 49, 65, 83, 104, 105, 108, 4; 340/3.1, 340/3.71, 3.72, 527; 715/700, 733, 735; 709/203

See application file for complete search history.

(56) References Cited

U.S. PATENT DOCUMENTS 5,319,574 A * 6/1994 Ikeda ..... 711/100
5,373,346 A * 12/1994 Hocker ..... 702/188

(Continued)

FOREIGN PATENT DOCUMENTS

DE 10305363 B4 2/2005
EP 1167698 A2 1/2002

(Continued)

OTHER PUBLICATIONS

Makansi, "Through the IT looking glass appears a new kind of company", Sep./Oct. 1999, pp. 22-24. 26-27, 29, 31, Power, XP000860784.

(Continued)

*Primary Examiner* — Mohammad Ali
*Assistant Examiner* — Jennifer L Norton

(57) ABSTRACT

Disclosed is a method for controlling a computer-assisted arithmetic process in a technical system, which is designed for interactive network-based use such that data is input by means of an interactive network-based operation. Said data is processed at least in part during the computer-assisted arithmetic process while the interactive operations is prevented from actively influencing the computer-assisted arithmetic process and vice versa by dissociating the interactive network-based operation and the computer-assisted arithmetic process. Also disclosed is a device for controlling a computer-aided arithmetic process in a technical system, which is designed for interactive network-based use. Said device comprises a client, a server, a data memory, as controller, and an application. The client is connected to the server to exchange data, the server is connected to the data memory to exchange data, the data memory is connected to the controller to exchange data, and the controller is connected to the application to exchange data.

14 Claims, 2 Drawing Sheets

U.S. PATENT DOCUMENTS

| | | | | |
|---|---|---|---|---|
| 6,298,377 | B1 * | 10/2001 | Hartikainen et al. | 709/223 |
| 6,499,001 | B1 * | 12/2002 | Meyer | 702/187 |
| 7,346,455 | B2 * | 3/2008 | Ward et al. | 702/6 |
| 7,831,704 | B2 * | 11/2010 | Schachtely et al. | 709/224 |
| 7,970,582 | B2 * | 6/2011 | Gruhn et al. | 702/183 |
| 2002/0038200 | A1 * | 3/2002 | Shimizu et al. | 702/188 |
| 2002/0173929 | A1 * | 11/2002 | Seigel | 702/130 |
| 2003/0033133 | A1 * | 2/2003 | Kleyer | 703/22 |
| 2003/0154055 | A1 * | 8/2003 | Yoshimura | 702/188 |
| 2003/0211451 | A1 * | 11/2003 | Bergeron et al. | 434/362 |
| 2004/0102924 | A1 | 5/2004 | Jarrell et al. | |
| 2004/0117049 | A1 * | 6/2004 | Bieber | 700/100 |
| 2004/0133416 | A1 * | 7/2004 | Fukuoka et al. | 704/3 |
| 2004/0176864 | A1 * | 9/2004 | Cocco et al. | 700/108 |
| 2005/0144264 | A1 * | 6/2005 | Gruhn et al. | 709/223 |
| 2011/0006906 | A1 * | 1/2011 | Pearson | 340/679 |

FOREIGN PATENT DOCUMENTS

| | | | |
|---|---|---|---|
| EP | 1435435 | A2 | 7/2004 |
| EP | 1507181 | A1 | 2/2005 |
| WO | WO 03077047 | A2 * | 9/2003 |

OTHER PUBLICATIONS

Kinn et al., "Intranetbasierendes Betriebsführungssystem Konzept, Realisierung and Erfahrung", Jul. 2000, pp. 51-56, VBG KraftwerksTechnik XP 000936028.

Seungjoon Lee et al., Institute of Electrical and Electronics Engineers: "Development of remote control system for boiler based on Internet" IEEE Tencon 02, 2002 IEEE Region 10 Conference on computers, communications, control and power engineering proceedings, Beijing, China, Oct. 28-31, 202, IEEE Region 10 Annual Conference, New York, NY, Bd. vol. 1 of 3, Oct. 28, 2002, pp. 1672-1675.

Humphris et al., "Datafuser—A powerfull tool to merge utility information", Dec. 2002, pp. 65-71, VGB Power Tech, vol. 82, Nr. 12, XP 0001141828.

Stang, "Integrierte Fernwartungssyteme", BWK Brennstoff Wärme, Kraft, Springer VDI Verlag pp. 49-52, XP 000720106.

* cited by examiner

METHOD AND DEVICE FOR CONTROLLING A COMPUTER-AIDED ARITHMETIC PROCESS IN A TECHNICAL SYSTEM

CROSS REFERENCE TO RELATED APPLICATIONS

This application is the US National Stage of International Application No. PCT/EP2006/067226, filed Oct. 10, 2006 and claims the benefit thereof. The International Application claims the benefits of European application No. 05022275.1 filed Oct. 12, 2005, both of the applications are incorporated by reference herein in their entirety.

FIELD OF INVENTION

The invention relates to a method for controlling a computer-aided computation process in a technical installation, which computation process permits interactive network-based use. The invention also relates to an apparatus which is particularly suitable for carrying out the method. The method and the apparatus are intended to be able to be used particularly as a diagnostic system in a power plant.

BACKGROUND OF THE INVENTION

During operation of a technical installation, for example a power plant, changing operating states arise over time (e.g. as a result of wear phenomena on the individual machine components) which need to be monitored. This monitoring can be used to establish whether the individual operating states are within admissible tolerances. This is done by recording a multiplicity of technical variables, e.g. temperature, pressure etc., using measuring systems, for example.

To determine the state of the technical installation, the recorded data are supplied to further processing, for example analysis or simulation of various scenarios. In this case, by way of example, computation processes are used whose interactive use via a network-based user interface is unwanted or technically limited. One of the reasons for this is the high security risk which network-based use entails, since sensitive data can be inadmissibly altered intentionally or unintentionally by other network users, for example. Another reason for this is that complex computation processes in which, by way of example, a plurality of clients retrieve services from a server performing the computation process are often not provided for a network application. Furthermore, computation processes which are used particularly for simulation or analysis require a very large amount of computation time, which means that the usual network-based user interfaces do not accept this waiting time.

Interactive network-based uses in such configurations have therefore been dispensed with to date. Normally, the computation process is installed on a single system, for example a workstation computer with the operator. This allows the computation process to be used by the operator directly. By way of example, this is the case with software where the operator receives the software directly and can use it directly with the aid of a license key or a dongle.

SUMMARY OF INVENTION

The object of the invention is therefore to specify a method for controlling a computer-aided computation process in a technical installation, which computation process allows interactive network-based use with a significantly increased rise in performance. Another object is to specify an apparatus which is suitable particularly for carrying out the method. The method and the apparatus are intended to be able to be used in a power plant, particularly as a diagnostic system.

The invention achieves the object relating to the method by means of a method for controlling a computer-aided computation process in a technical installation, which computation process is designed for interactive network-based use, so that interactive network-based operator control is used to input data, where at least some of these data are utilized in the computer-aided computation process, and where decoupling the interactive network-based operator control and the computer-aided computation process avoids active influence by the interactive operator control on the computer-aided computation process, and vice versa.

The underlying principle of the invention is therefore that the interactive network-based operator control, that is to say essentially the input of data and the output of result data, and the actual processing of the data are decoupled. This avoids active influence by the interactive operator control, for example using manual operator control by an operator, on the computer-aided computation process. A fundamental advantage of the method is that the computer-aided computation process, for example a complex computer-aided analysis or a simulation process, can be controlled by means of interactive operator control via a network interface. This means that a large number of, by way of example, complex computation processes can now be used with interactive network-based operator control. This means that the computer-aided computation process no longer needs to be delivered to each user, but rather a plurality of users can access one and the same computation process. This significantly simplifies the maintainability of the computer-aided computation process, for example in the event of errors occurring or else in the event of updates, which can now be performed centrally. Another fundamental advantage is that the computer-aided computation process can now be used by a large number of operators simultaneously (multiuser capability). This is advantageous particularly when although a, large number of operators wish to use the computation process the individual operators are using the capacity of the computer-aided computation process only to a relatively small extent. Another advantage is that despite this decoupling for the operator of the interactive network-based operator control the impression still remains that he is controlling the processing of the computer-aided computation process itself. However, this decoupling means that he is controlling only the input of the input data and the output of the result data using the interactive network-based operator control. The operator himself has no access to the computer-aided computation process itself, which reduces the security risk when using sensitive data in the computation process. In addition, the decoupling also reduces the security risk in transmitting sensitive, that is to say high-risk, data. A rise in performance is therefore obtained particularly with respect to security, maintenance and multiuser capability.

Preferably, the interactive network-based operator control is effected by one or more operators. This is particularly advantageous when the operators at different locations on different computer systems, for example workstation computers, are accessing the computer-aided computation process using interactive network-based operator control. This is firstly a cost advantage, since the computer-aided computation process is delivered only once, and secondly it increases maintainability (for example in the event of updates), these needing to be executed only once and also being able to be performed online, for example, by the supplier or a system administrator.

Advantageously, it is made possible for a plurality of operators to access the computer-aided computation process simultaneously. Simultaneous access avoids unnecessary waiting times, in particular. A further advantage is obtained in that a plurality of invoices can be started simultaneously, for example in the evening, and can be processed overnight.

Preferably, the computer-aided computation process in/on the technical installation (T) prompts diagnosis for at least part of the technical installation. Diagnostic processes are continually required in the technical installation particularly in respect of changing operational data. In addition, sensitive data, that is to say data concerning the technical installation, are being processed here. The large volume of data means that these are usually also complex processes.

With further preference, the data required for the diagnosis are measured using a measuring system in/on the technical installation. In this case, the measuring system may also be coupled directly to the interactive network-based operator control, so that direct manual input of the data is no longer required.

The invention achieves the object relating to the apparatus by means of an apparatus for controlling a computer-aided computation process in a technical installation, which computation process is designed for interactive network-based use, comprising a client, a server, a data store, a controller and an application, where the client is connected to the server for the purpose of data interchange, the server is connected to the data store for the purpose of data interchange, the data store is connected to the controller for the purpose of data interchange and the controller is connected to the application for the purpose of data interchange, and where the data store is designed such that active influence by the client on the application and vice versa is avoided. The apparatus is particularly suitable for carrying out the method described above. The advantages of the method are therefore also obtained for the apparatus.

In one preferred refinement, the data interchange between the client, the server, the data store, the controller and the application is provided entirely or at least partly in wireless form. In this case, the data transmission can take place using a WLAN (Wireless Local Area Network) for example. This allows a greater level of flexibility to be achieved.

Preferably, the client is connected to the server via the Internet/an intranet. An advantage in this context is that the supplier of the application, usually the manufacturer, does not need to let the application out of his hands, but rather can sell services with the application. This is particularly important when the computation process contains sensitive data and there is the risk of unintentional disclosure of these data.

Preferably, the data store is a passive data store. This means that although the data store can execute commands from the controller or from the server it cannot give active commands to the controller or server, that is to say cannot perform any actions in the controller or server.

In one preferred refinement, one or more clients are connected to one or more servers which is/are connected to the database. This increases reliable use of the application, since failure of a client or a server does not prevent the use of the application by the other operators.

In one preferred refinement, the data store is provided on a physically independent data server. In this case, the data server may be designed such that it is coupled to the server only via a network connection. A special configuration for the software may mean that this results in an increase in the access time, for example. Alternatively, the client, the server, the data store, the controller and the application are provided on a computer system. This is advantageous particularly when the application is being used primarily by one operator or when the computer system is provided exclusively at one particular site (for example a measuring room).

Alternatively, the client, the server, the data store, the controller and the application are provided on physically independent computer systems. In this situation, the reliability of the application is increased, since failure of the client does not mean failure of the application. Alternatively, other arrangements of the client, server, data store, controller and application on one or more physically or virtually (different partitions, hard disks) different computer systems are also possible.

Preferably, the technical installation is a power plant. In a power plant, this apparatus may be used as a diagnostic apparatus.

BRIEF DESCRIPTION OF THE DRAWINGS

Further advantageous refinements of the invention can be found in the description. The invention is explained in more detail below by way of example with reference to a drawing.

The drawing is a simplified illustration which is not to scale, where:

Identical parts have been provided with the same reference symbols in all figures.

FIG. 1 shows a schematic arrangement of an apparatus for controlling a computer-aided computation process in a technical installation (T). This comprises a client (C), which is in the form of a web browser for displaying the interactively controllable user interface, for example. The client (C) is connected to a server (W) for the purpose of data interchange. The server (W) is in the form of a web server, for example. The server (W) is connected to a data store (S), advantageously a database, for the purpose of data interchange. The data store (S) in turn is connected to a controller (L) for the purpose of data interchange, said controller being connected to an application (A). The controller (L) is advantageously a control program for activating the application (A). The application (A) is advantageously the computer-aided computation process. In this case, the apparatus is integrated on or in a technical installation (T). Preferably, measuring devices (not shown) are connected to the apparatus and supply the data for implementing the application (A).

FIG. 2 shows a method for controlling a computer-aided computation process in a technical installation (T).

Figure 1:
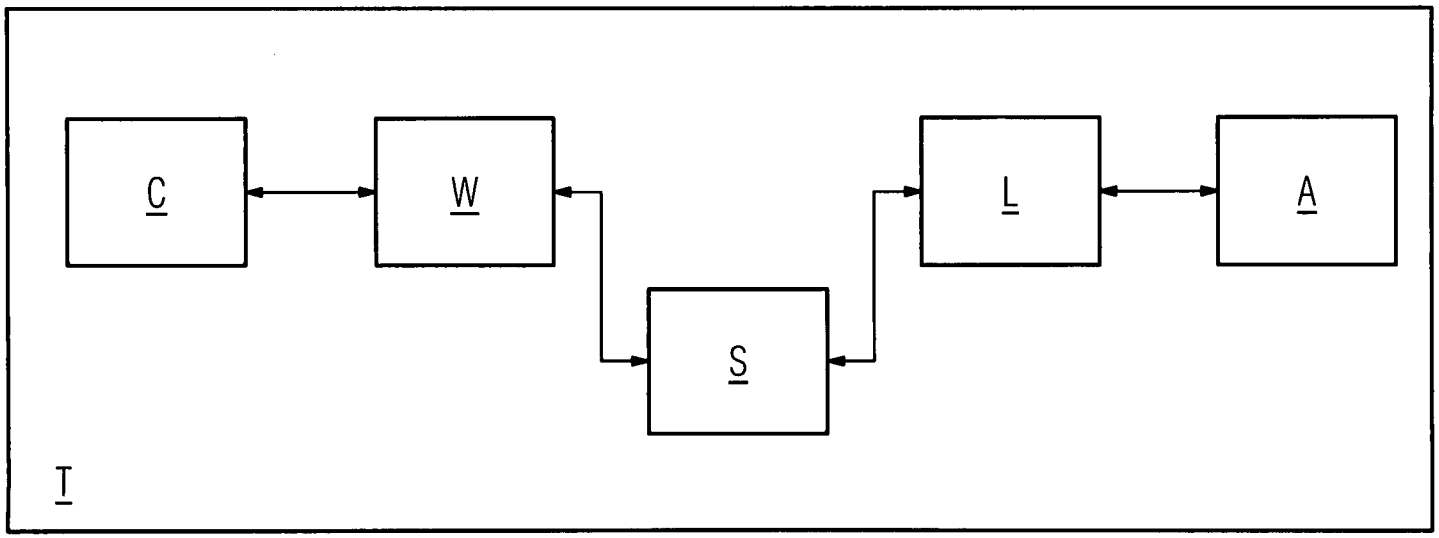
FIG. 1 shows an apparatus for controlling a computer-aided computation process in a technical installation.
Figure 2:
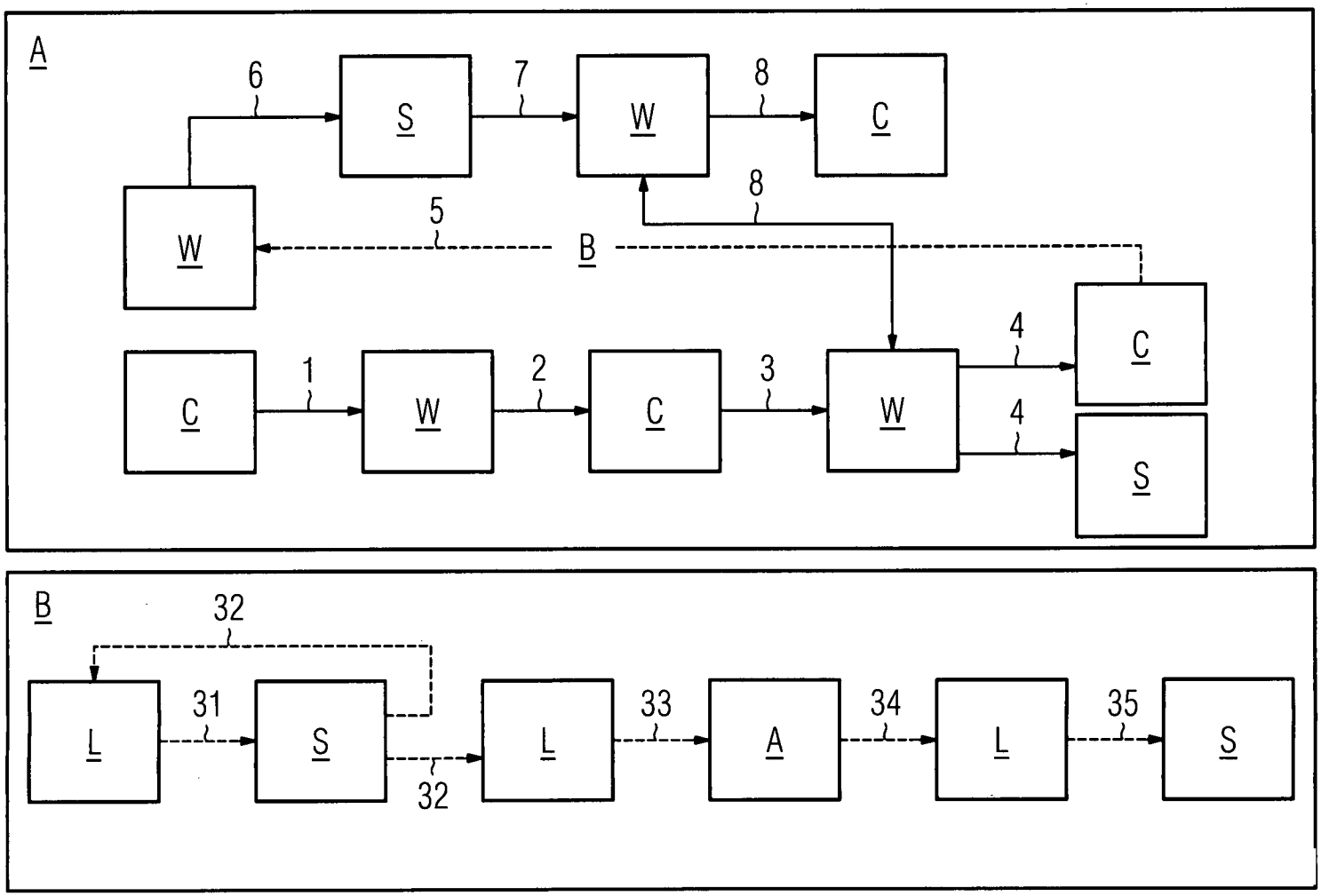
FIG. 2 shows a method for controlling a computer-aided computation process in a technical installation.

This can be divided coarsely into two parts A and B.

In this context, part A essentially comprises steps 1-8, which are briefly outlined below. In the 1st step, the client (C) sends a request to the server (W) indicating that it wishes to use the application (A). The server (W) then sends a form, for example an interactive user interface, in step 2 for the purpose of inputting the data into the client (C). The data can be input by an operator, manually or automatically using a program which receives data by means of a measuring device. In step 3, the client (C) returns the form containing the input data to the server (W). The server (W) takes the input data and generates a data record which it provides with a special marker. This marker shows that this data record merely contains input data. The server (W) sends this data record to the data store (S), step 4. There, the data record is stored. In connection with step 4, the server (W) sends the client (C) confirmation about receipt of the input data and activates a timer with a waiting time, based on the input of the data and the processing of the data by the application (A), on the client (C). The passage of the waiting time is indicated on the user interface of the client (C), advantageously by means of a notification, for example a progress bar. The processing of the input data is described in part B. No later than when the waiting time has elapsed or else upon a request from the operator, the client (C) starts a request to the server (W) for the result data associated with the input data, step 5. The server (W) asks the data store (S) for the data record associated with the input data, step 6. In step 7, the data store (S) sends the data record to the server (W). The server (W) then checks the data record's marker. If the marker shows that the data record contains only input data, step 8 returns to step 4 and the timer is activated again. If the marker shows that the data record contains result data then the server (W) sends these to the client (C) in step 8 and deactivates the timer.

In part B, separately from the actual input of the input data by the operator, the application (A), for example the computer-aided computation process, is processed with the input data.

To this end, the controller (L) asks the data store (S) in a step 31 for a data record which contains a marker indicating that this data record contains just input data. If no such data record is present in the data store (S) then it returns to step 31 again in a step 32. This can be done immediately or after a waiting time which has been set in advance. If the data store (S) contains such a data record, it is transferred to the controller (L) in step 32. Advantageously, when there are a plurality of such data records available they are sent to the controller (L) in chronological order. In a step 33, the controller (L) transfers the data record received to the application (A). The application (A) performs the function required by the operator with the received inputs. This may be a computer-aided computation process, for example in the form of a simulation, a complex calculation or an analysis for diagnosis in the technical installation (T). In a step 34, the application (A) sends the results to the controller (L). The controller (L) adds to or replaces the data record, previously containing only input data, in the data store (S), step 35. In addition, it alters the marker for the data record, specifically such that now the marker indicates the presence of result data. The controller (L) then executes step 31 again.

A fundamental advantage in this method is that the client (C), that is to say in principle the operator, is decoupled from the actual processing of the application (A) which the operator requires. This is done by virtue of the data store (S) being in the form of a passive element, so to speak, that is to say that it is not able to initiate actions on the controller (L) or the server (W), but rather just stores or supplies data on the basis of a command which has been sent to it. In addition, the different markers in the case of the input and result data records reduce the security risk when transmitting sensitive, that is to say high-risk data. Another fundamental advantage is that the application (A), for example complicated computer-aided computation processes, can be controlled with interactive operator control via a network interface, and hence the application (A) no longer needs to be delivered to each user. This also simplifies maintainability, for example in the case of errors arising or else in the case of updates for the application (A). Updates or errors can therefore be handled quickly centrally by the manufacturer or a system administrator. The specification of this method and of the apparatus allows a computer-aided computation process to be controlled in conjunction with interactive network-based use given the significantly increased rises in performance particularly with regard to security, maintenance and multiuser capability.

The invention claimed is:

1. A method for controlling a computer-aided computation process designed for interactive network-based use in a technical installation, comprising:

in-putting measurement data of the technical installation via an interactive network-based operator control;

utilizing a data store to receive and store the in-putted measurement data utilizing at least a portion of the measurement data from the data store in the computer-aided computation process and supplying result data from the computer-aided computation process to the data store; and communicating the result data from the data store to the client, wherein the interactive network-based operator control and the computer-aided computation process are decoupled to avoid active influence by the interactive operator control on the computer-aided computation process, and vice versa, wherein the decoupling is achieved by virtue of the interactive network-based operator control and the computer-aided computation process having the data store connected between them which is designed such that data are only stored into the data store or supplied from the data store on the basis of a command which has been sent to the data store, wherein data supplied to data store is provided a marker identifying the data as either input data or result data, wherein the method includes the step of checking the marker prior to supply of data from the data store, such that only data marked as input data is supplied from the data store to the computation process, and only data marked as result data is supplied from the data store to the interactive network-based operator control.

2. The method as claimed in claim 1, wherein the data store is accessed either via a server, connected to a client for the interactive network-based operator control, or via a controller connected to an application for carrying out the computation process.

3. The method as claimed in claim 2, wherein the interactive network-based operator control is effected by one or more operators.

4. The method as claimed in claim 3, a plurality of operators access the computer-aided computation process simultaneously.

5. The method as claimed in claim 4, wherein the computer-aided computation process in/on the technical installation prompts diagnosis for at least part of the technical installation.

6. The method as claimed in claim 5, wherein the data required for the diagnosis are measured using a measuring system in/on the technical installation.

7. An apparatus for controlling a computer-aided computation process for interactive network-based use in a technical installation, comprising:

a server;

a client connected to the server for providing measurement data of the technical installation;

a data store connected to the server, such that the server supplies the measurement data received from the client to the data store to be stored therein;

an application for utilizing at least a portion of the measurement data from the data store in a computer aided computation process to generate result data to be supplied back to the data store, wherein the application is connected to the data store via a controller such that the controller controls interchange of data between the application and the data store, wherein the server is configured to obtain result data from the data store and send the obtained result data to the client, wherein the data store is designed such that data is stored into the data store or supplied from the data store only in response to a command sent to the data store by the server or by the controller, such that active influence by the client on the application and vice versa is avoided, wherein data supplied to data store is provided a marker identifying the data as either input data or result data, wherein the marker is checked prior to supply of data from the data store, such that only data marked as input data is supplied from the data store to the application via the controller, and only data marked as result data is supplied from the data store to the client via the server.

8. The apparatus as claimed in claim 7, wherein the data interchange between the client, the server, the data store, the controller and the application is provided entirely or at least partly in wireless form.

9. The apparatus as claimed in claim 8, wherein the client is connected to the server via the Internet/an intranet.

10. The apparatus as claimed in claim 9, wherein one or more clients are connected to one or more servers which is/are connected to the data store.

11. The apparatus as claimed in claim 10, wherein the data store is provided on a physically independent data server.

12. The apparatus as claimed in claim 11, wherein the client, the server, the data store, the controller and the application are provided on a computer system.

13. The apparatus as claimed in claim 12, wherein the client, the server, the data store, the controller and the application are provided on physically independent computer systems.

14. The apparatus as claimed in claim 13, wherein the technical installation is a power plant.

* * * * *